US009981307B2

(12) United States Patent
Schaefer et al.

(10) Patent No.: US 9,981,307 B2
(45) Date of Patent: May 29, 2018

(54) FEEDER WITH NETLIKE WEBBING SPANNING ITS FEEDER OPENING

(71) Applicant: GTP SCHAEFER GIESSTECHNISCHE PRODUKTE GmbH, Grevenbroich (DE)

(72) Inventors: Joerg Schaefer, Cologne (DE); Thomas Schaefer, Frechen (DE)

(73) Assignee: GTP SCHAEFER GIESSTECHNISCHE PRODUKTE GMBH, Grevenbroich (DE)

( * ) Notice: Subject to any disclaimer, the term of this patent is extended or adjusted under 35 U.S.C. 154(b) by 0 days. days.

(21) Appl. No.: 15/247,325

(22) Filed: Aug. 25, 2016

(65) Prior Publication Data

US 2017/0056964 A1 Mar. 2, 2017

(30) Foreign Application Priority Data

Aug. 27, 2015 (DE) ..... 20 2015 104 554 U

(51) Int. Cl.
*B22C 9/08* (2006.01)

(52) U.S. Cl.
CPC ..... *B22C 9/088* (2013.01); *B22C 9/08* (2013.01)

(58) Field of Classification Search
CPC ..... B22C 9/08; B22C 9/088
See application file for complete search history.

(56) References Cited

FOREIGN PATENT DOCUMENTS

| | | | | |
|---|---|---|---|---|
| DE | 3244079 A1 * | 6/1984 | ..... | B22C 9/086 |
| GB | 1464117 A * | 2/1977 | ..... | B22C 9/084 |

OTHER PUBLICATIONS

Hitchings et al. "Use Fabric, Breaker Cores to Cut Ductile Iron Finishing Cost". Reprinted from Feb. 1999 Modern Casting. http://www.comanchetechnologies.com/Documents/De-Gating%20Tech%20Paper%20to%20Revisit.pdf.*
English Machine Translation of DE 3244079.*

* cited by examiner

*Primary Examiner* — Kevin P Kerns
*Assistant Examiner* — Steven S Ha
(74) *Attorney, Agent, or Firm* — Johnson, Marcou & Isaacs, LLC; Jennifer S. Stachniak

(57) ABSTRACT

A feeder (10) for use in a casting mold includes a feeder body (11) made from an exothermic and/or insulating material. The feeder body has a bottom surface (15) with a feeder opening (16) for connection of the inner cavity (12) of the feeder body (1) with the mold cavity of the casting mold during a casting process. A ring-shaped frame (17) made of a heat-resistant material is secured to the feeder body (11). A netlike webbing (18) made from a fire-resistant material is tensioned within the ring-shaped frame (17). The frame (17) is arranged on the surface (15) of the feeder body (11), such that the netlike webbing (18) is positioned with the feeder (10) formed in the casting mold directly on a surface of a casting piece to be formed during casting.

14 Claims, 2 Drawing Sheets

FEEDER WITH NETLIKE WEBBING SPANNING ITS FEEDER OPENING

CROSS-REFERENCE TO RELATED APPLICATIONS

The instant application claims the priority date of Aug. 27, 2015, the filing date of the German patent application DE 20 2015 104 554.9.

BACKGROUND OF THE INVENTION

The present invention relates to a feeder in the form of a head feeder for use in a casting mold during casting of metals, having a feeder body comprised of an exothermic and/or insulating material and which surrounds an inner hollow cavity as a feeder volume, which has a feeder opening in its bottom or floor surface facing the mold cavity formed in the casting mold, the feeder opening provided for connecting the inner cavity of the feeder body with the mold cavity of the casting mold during the casting process.

In casting technology, it often is necessary to arrange an additional feeder in the casting mold, whose feeder body is filled with the liquid metal during casting of the casing piece and upon hardening of the casting piece, the feeder body compensate volume deficits that occur, in order to prevent the formation of cavitation shrink holes in the casting piece. In this connection, the feeder must be produced, such that the liquid metal that is fed into it hardens later than the casting piece, so that during the hardening process, a material transport to the casting piece can occur, which sealingly feeds the casting piece. In this regard, the feeders comprise an exothermic and/or insulating material or are formed as so-called natural feeders in the mold sand surrounding the casting model. In the frame of known methods for manufacturing casting molds that are provided with feeders, the feeders are arranged with any desired geometric form on the position to be supplied of the later casting piece on the casting model and with the formation of the casting mold by dealing of the mold sand that is applied, are solidly cast or molded. With another method, during casting of the casting model hollow spaces are produced by means of the mold sand, in which individual feeders made of an exothermic and/or insulating material are subsequently inserted and in this manner, are connected to the mold cavity produced by the demolding of the casting model in the casting mold. Thus, the feeders are arranged as so-called head feeders uniformly on the surface of the casting model or on the later=produced casting piece. A feeder with the above-noted characteristic features is described, for example, in DE 20 2013 104 863 U1.

A problem generally exists when using feeders. Specifically, after casting, hardened casting material in the form of so-called feeder residue remains in the feeder body, which must be removed after removing the casting piece from the feeder body. In order to facilitate this separation, the use of so-called breaker cores is common, which are defined on the feeder body on the underside of the feeder body facing toward the mold cavity of the casting mold. The breaker cores are made of a fire-resistant material and have a through-opening, via which the increasingly hot metal can flow out of the mold cavity of the casting mold into the inner cavity of the feeder body or from there flow further back into the mold cavity. The breaker cores, which are generally manufactured by shooting in a core shooting machine, are disk-shaped, whereby the through-opening is formed by a constriction formed in the disc-shaped breaker core body, in order to produce a predetermined breaking point for breaking off feeder residue from the surface of the casting piece. Such an arrangement of the feeder with a breaker core is described, for example, in WO 2009/103539A1.

Breaker cores now have a netlike webbing which is anchored on the breaker core and which spans the through opening formed by the constriction. These netlike webbings permit the entry of the liquid metal in the cavity of the feeder body or from it back into the mold cavity, but also form a metal layer that is penetrated by the webbing, based on the bathing of the net structure by the hot metal after hardening of the casting piece, and thereby creates a defined material weakness, whereby the existing feeder residue can be knocked off in the course of the webbing layer. Thus, the netlike webbing, with the manufacture of the breaker core, is positioned in the plane of the constriction in the shooting mold and shot with the fire resistance molding material mixture that is used to make the breaker core.

The disadvantage of using a breaker core made in this manner is that with the arrangement of the netlike webbing in the interior of the breaker core, a spacing of the webbing from the surface of the casting piece is required, so that after breaking off of the feeder residue in the predetermined breaking points formed by the netlike webbing, a part of the feeder residue still remains on the casting part, which in turn, must be still be removed by expensive cleaning processes. Thus, the breaker core represents an additional and in particular, if including a netlike webbing, an expensive component that must be made.

SUMMARY OF THE INVENTION

The present invention is therefore based on the object of improve a feeder with the above-noted features, such that a breaker core can be eliminated and nevertheless, the occurrence of material residue remaining on the casting piece after the casting process and which must be removed by cleaning process is further reduced.

The present invention contemplates a feeder with the above-noted features, in which a ring-shaped frame made of a heat-resistant material and having a netlike webbing tensioned over the frame is secured to the feeder body, the netlike webbing made of a fire-resistant material and spanning the feeder opening of the feeder body, whereby the frame is arranged on the bottom surface of the feeder body, so that the netlike webbing is positioned with the feeder formed in the casting mold directly on the surface of the casting piece to be formed by the casting process.

An important advantage is connected with the present invention. Specifically, based on the arrangement of the frame with the netlike webbing retained thereon on the bottom surface of the feeder, the plane of the netlike webbing is positioned in the lower, bottom surface of the feeder that contacts the casting model, so that the predetermined breaking point formed by the netlike webbing for the removal of the feeder residue is displaced directly onto the surface of the casting piece. Thus, any additional cleaning expense are minimal. A further advantage is that the frame with the netlike webbing is much simpler to make than a common breaker core with a net arranged thereon. In so far as a sufficient tensioning of the netlike webbing in the flow path between the mold cavity and the feeder must be ensured, so that the webbing, during the flowing of the liquid metal during pouring, is not pulled into the mold cavity and therewith, into the casting piece structure, the arrangement of the frame makes possible a corresponding tensioning and retention of the netlike webbing in the frame. The use of a frame made from a heat-resistance material for holding the tensioned netlike webbing offers the advantage that the frame is not melted by the hot metal flowing through the breaker core and thus, no combustion gasses that are damaging to the casting process are present.

According to one embodiment of the invention, it is provided that the frame comprises two frame parts which are placed against one another to hold the webbing therebetween. The two frame parts can be attached to one another after appropriate tensioning of the netlike webbing. The frame parts can be fixed together by welding, particular, at individual points using spot welding.

According to the present invention, the width of the frame may correspond to the material thickness of the feeder body on its bottom surface and the frame is disposed on the bottom surface of the feeder body and is secured to the feeder body, whereby this attachment, for example, can be created by means of a clamping connection of the frame and feeder body or through an adhesive connection.

In this regard, the frame, at least in some areas, projects outwardly over the periphery of the feeder body. The areas of the frame that projects over are bent up when the frame is positioned on the bottom surface until it contacts the outer periphery of the feeder body, so that the bent-up region of the frame fixedly clamps onto the feeder body. Therefore, it is not necessary that the frame is clamped over its entire periphery or circumference with the feeder body. In addition, it is sufficient if the frame has a plurality of tongues that can be bent upwardly distributed about its circumference which project over the feeder body for securing the frame to the feeder body.

Alternatively, it can be provided that the frame is adhered with the bottom surface of the feeder body.

With regard to the formation of the netlike webbing, according to the present invention, the netlike webbing has a through-hole with a smaller dimension that the through-opening of the breaker core in order to reduce flow resistance. According to another embodiment of the present invention, the through-hole can have a surface of 10% to 50% of the surface of the through-opening of the breaker core that is surrounded by the frame, whereby the width of the net, that is the width of the net opening, is 1 mm to 20 mm with a width of the fibers forming the net structure being 1 to 15 mm.

According to an embodiment of the invention, the frame can be made from metal as the heat-resistance material. Since the underside of the frame facing away from the feeder can come into contact with the liquid metal from the side of the casting mold or from its mold cavity, the casting part could be connected with the frame because of the heat of the liquid metal, which in turn, would make a separation of the feeder residue more difficult. Thus, if a metal is used as the material for making the frame, the underside of the frame that faces the mold cavity is provided with a heat-resistant coating. In this connection, for example, a fire-resistant die coating can be used.

Alternatively, the frame can be made from ceramic or a fire-resistant material as the heat-resistance material.

BRIEF DESCRIPTION OF THE DRAWINGS

An exemplary embodiment of the present invention is shown in the drawings and will be described in greater detail below. In the figures.

DETAILED DESCRIPTION OF THE PREFERRED EMBODIMENTS

Figure 1:
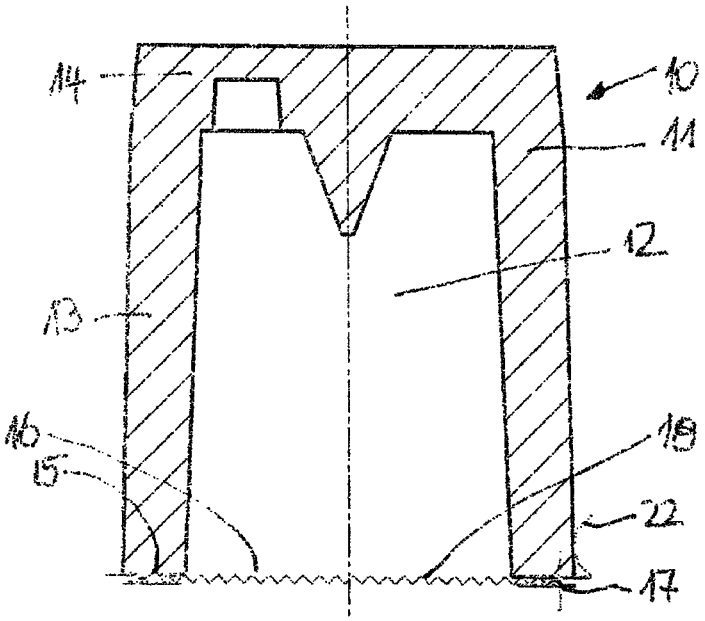
FIG. 1 shows a feeder with a frame attached to its underside with a netlike webbing tension thereon in a schematic cross section.

The feeder 10 shown in FIG. 1 has a feeder body 11, which includes a wall region 13 surrounding an inner cavity 12 as a so-called feeder volume and an upper cover region 14. A lower bottom surface 15 is disposed opposite to the cover region 14; a feeder opening 16 is formed in the lower bottom surface 15. In the feeder formed in the casting mold, the feeder opening 16 forms the connection between the inner cavity 12 of the feeder body and the mold cavity formed in the casting mold, so that during the casting process, the liquid metal introduced into the mold cavity through the feeder opening 16 enters into the inner cavity and if necessary, can flow back in the manner of a "feeding" again into the mold cavity.

A frame 17 is mounted to the lower bottom surface 15 of the feeder 10, which holds a netlike webbing, which spans the feeder opening 16 of the feeder formed in the lower bottom surface 15.

The frame 17 comprises two frame parts, specifically, an upper frame part 19 facing the feeder body 11 and a lower frame part 20, facing away from the feeder body 11, whereby the two frame parts 19, 20 retain the netlike webbing 18 between them. After application of the required tensioning of the netlike webbing 18, the two frame parts 19, 20 are fixed to one another, preferably welded with one another. In this manner, a stabile component exists, which can be safely manipulated during manufacture of the feeder.

Figure 2:
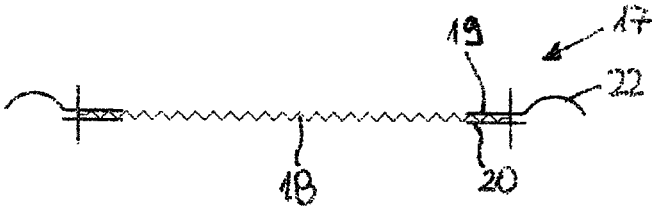
FIG. 2 shows the frame according to FIG. 1 in a detailed representation before attachment to the feeder body.
Figure 3:
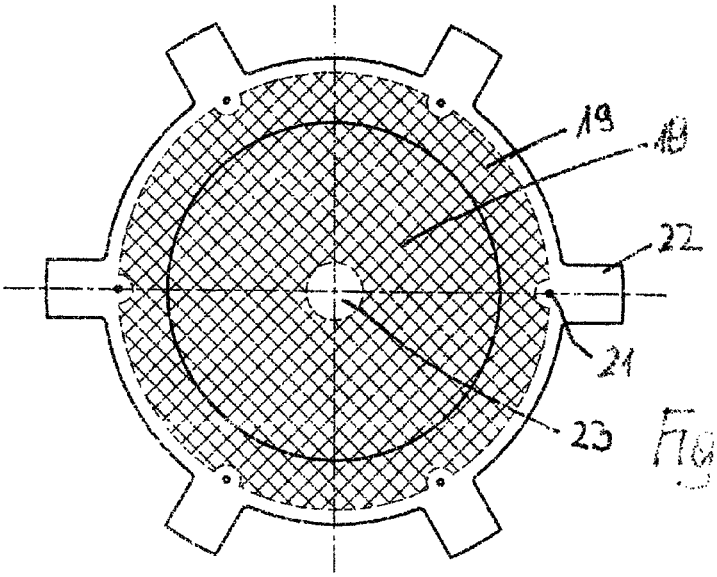
FIG. 3 shows the frame according to FIG. 2 in a plan view.
Figure 4:
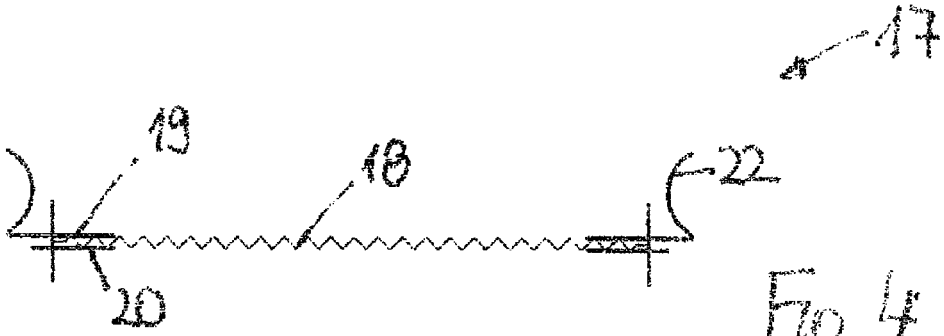
FIG. 4 shows the frame according to FIG. 2 attached to the feeder body without representation of the associated feeder body.

As shown in FIGS. 2 through 4, the frame 17, which corresponds in its width to the material thickness of the feeder body 11 on its bottom surface, has a plurality of tongues 22 distributed along its circumference and projecting over the circumference or periphery of the feeder body 11, whereby with the embodiment shown, the tongues 22 are formed only on the upper frame part 19. After the frame 17 is placed on the lower bottom surface 15 of the feeder body 11, the tongues 22 are bent up, until they are moved into a clamping position on the outer circumference of the feeder body 11 and in this manner, the frame 17 is secured to the feeder body 11.

Figure 5:
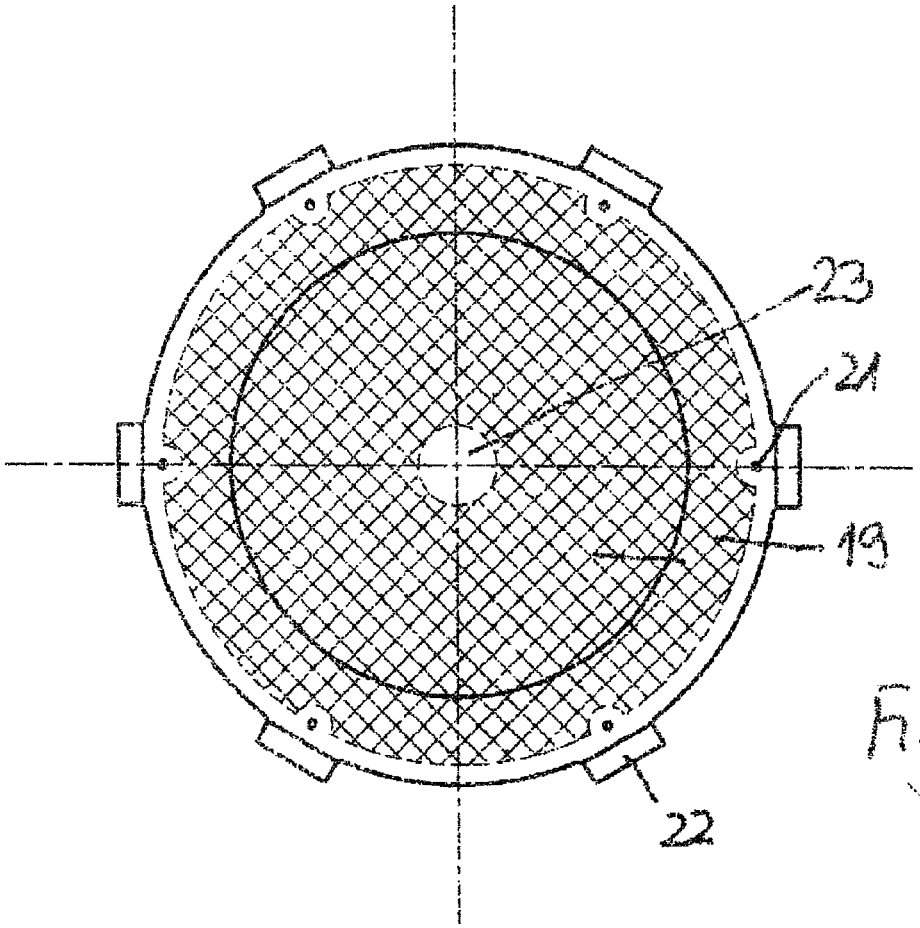
FIG. 5 shows the frame according to FIG. 4 in a plan view.

FIGS. 3 and 5 show that the netlike webbing 18 has a through hole 23 in its center for reducing flow resistance, the through-hole 23 being dimensioned to be smaller than the feeder opening 16 of the feeder 10. In addition, the points 21 arranged in the region of the tongues 22 can be seen, at which the two frame parts 19, 20, after placement and tensioning of the netlike webbing 18, are spot-welded.

The features of the subject matter of this invention set forth in the above description, the patent claims, the abstract and the drawings can be used individually and in any desired combination for the realization of the invention in its various embodiments.

The specification incorporates by reference the disclosure of DE 20 2015 104 554.9, filed Aug. 27, 2015.

The present invention is, of course, in no way restricted to the specific disclosure of the specification and drawings, but also encompasses any modifications within the scope of the appended claims.

We claim:

1. A feeder (10) in the form of a feeder body for use in a casting mold used for casting metals, comprising:

a feeder body (11) made from an exothermic and/or insulating material, the feeder body surrounding an inner cavity (12) as a feeder volume, the feeder body having a bottom surface (15) facing a mold cavity formed in the casting mold, the bottom surface (15) having a feeder opening (16) for connection of the inner cavity (12) of the feeder body (11) with the mold cavity of the casting mold during a casting process;

a ring-shaped frame (17) comprising a heat-resistant material secured to the feeder body (11);

a netted webbing (18) comprising a fire-resistant material and spanning the ring-shaped frame (17) in a tensioned manner, the netted webbing (18) spanning the feeder opening (16) of the feeder body (11), wherein the netted webbing (18) has a through-hole (23), wherein said through-hole (23) is smaller than the feeder opening (16) of the feeder (10), and wherein the frame (17) is secured on the bottom surface (15) of the feeder body (11), such that the netted webbing (18) is positioned with the feeder (10) formed in the casting mold directly on a surface of a casting piece to be formed during casting.

2. The feeder (10) according to claim 1, wherein the frame (17) comprises two frame parts (19, 20) positioned against one another and receive the netted webbing (18) therebetween, wherein the frame parts are securable to one another after application of a required tensioning force on the netted webbing (18).

3. The feeder (10) according to claim 2, wherein the frame parts (19, 20) are secured to one another via welding.

4. The feeder (10) according to claim 3, wherein the frame parts (19, 20) are secured to one another via spot welding.

5. The feeder (10) according to claim 1, wherein a width of the frame (17) corresponds to a material thickness of the feeder body (11) on the bottom surface (15).

6. The feeder (10) according to claim 1, wherein the frame (17) projects outwardly at least in one area over a periphery of the feeder body (11), wherein the at least one area the frame (17) that projects over said periphery of the feeder body (11) is bent up when the frame is positioned on the bottom surface (15) until contacting an outer periphery of the feeder body (11), so that the at least one area of the frame (17) that is bent up fixedly clamps onto the feeder body (11).

7. The feeder (10) according to claim 6, wherein the frame (17) has a plurality of tongues (22) configured to be bent upwardly, wherein said tongues are positioned about a circumference of the frame (17), wherein said tongues (22) are configured for attachment of the frame (17) to the feeder body (11).

8. The feeder (10) according to claim 1, wherein the frame (17) is clamped with the bottom surface (15) of the feeder body (11).

9. The feeder (10) according to claim 1, wherein the frame (17) is made from metal.

10. The feeder (10) according to claim 9, wherein an underside of the frame (17) that faces toward the mold cavity of the casting mold is provided with a fire-resistant coating.

11. The feeder (10) according to claim 1, wherein the frame is made of a ceramic material.

12. The feeder (10) according to claim 1, wherein the frame (17) is made from a fire-resistant material.

13. The feeder (10) according to claim 1, wherein the through-hole (23) has a surface of 10% to 50% of the surface of the netted webbing (18) enclosed by the frame (17).

14. The feeder (10) according to claim 1, wherein a width of a net opening in the netted webbing (18) is 1 mm to 20 mm, wherein the netted webbing (18) is formed of fibers, each of said fibers having a width of 1 mm to 15 mm.

* * * * *